US005535695A

United States Patent [19]

Southwell

[11] Patent Number: 5,535,695

[45] Date of Patent: Jul. 16, 1996

[54] SPAR TRACK LUBRICATION APPARATUS

[76] Inventor: Robert S. Southwell, 410 Wycliffe Dr., Houston, Tex. 77079

[21] Appl. No.: 447,081

[22] Filed: May 22, 1995

[51] Int. Cl.[6] ..... B63B 17/00

[52] U.S. Cl. ..... 114/221 R; 114/89; 184/14

[58] Field of Search ..... 114/221 R, 89, 114/90, 112; 184/14, 100, 21

[56] References Cited

U.S. PATENT DOCUMENTS 1,985,346 5/1934 Payne ..... 184/21

4,278,472 7/1981 Swanson ..... 15/210.1

5,140,718 8/1992 Toth ..... 114/221 R 5,261,143 11/1993 Toth ..... 114/221 R

*Primary Examiner*—Sherman Basinger

*Attorney, Agent, or Firm*—Bill B. Berryhill

[57] ABSTRACT

Apparatus for dispensing lubricant to an elongated spar track. The apparatus includes a mounting plate adapted to receive a container of lubricant from which lubricant may be dispensed to the spar track. Guide assemblies are attached to the mounting plate for engagement with the spar track and for guiding the apparatus along the spar track in response to a moving force applied thereto.

14 Claims, 2 Drawing Sheets

SPAR TRACK LUBRICATION APPARATUS

BACKGROUND OF THE INVENTION

1. Field of the Invention

The present invention pertains to maintenance of sailboats. More specifically, the present invention pertains to apparatus for lubricating spar tracks which are engaged by slugs, slides, cars or other sailboat components of sails.

2. Description of the Prior Art

A sailboat is equipped with sails, supporting spars and rigging for the movement and navigation thereof. "Spar" is the general term for various poles or system of poles used to support sails. Some spars have specific names such as mast, boom, gaff, etc. The term "spar" as used herein is intended to encompass any type of spar.

Many sailboat spars, particularly masts, are provided with spar tracks or grooves for engagement with corresponding slides, slugs, cars, etc. attached to the edge of sails to facilitate the handling of sails, particularly the hoisting and the lowering thereof. These spar tracks may take various forms, two forms (an internal form and an external form) being the most common. An internal spar track typically comprises an elongated channel of T-shaped cross-section defined by an elongated centrally opening slot from each side of which extends side slots. Such tracks are typically engageable with slugs attached to the edge of a sail so that the slugs slide within the T-shaped channel upon raising or lowering of the sail to properly position the edge of sail along the spar.

An external spar track may comprise a pair of elongated flange portions, the outer edges of which project in opposite directions for engagement by slide members which are attached to the edges of a sail. In some cases, components referred to as cars may be attached to the edges of sails instead of the slides. These "cars", sometimes referred to by other names, are usually provided with at least a pair of rimmed wheels, the rimmed edges of which engage the outer flange edges of an external type spar track for raising or lowering of the sails to which the cars are attached.

Most spar tracks are fabricated from metal, metal alloys, plastic or other suitable materials. Due to corrosion, grime, sea water, salt and other effects of weathering, friction between spar tracks and the slugs, slides, cars or other components engageable therewith, increase over time. Increased friction, of course, makes it more difficult to raise and lower sails and to quickly employ or deploy them as needed. Accordingly, it is necessary to maintain these spar tracks by cleaning and/or lubricating them from time to time. Examples of apparatus for cleaning a spar track may be seen in U.S. Pat. Nos. 5,140,718 and 5,261,143.

Portions of some spar tracks, particularly those associated with masts, are not easily accessible for cleaning and/or lubrication. Most sailboat owners attempt to lubricate such spar tracks by spraying the slugs, slides or cars engageable therewith hoping that a certain amount of lubricant will be transferred to the spar track as the sail is raised and lowered. While this may be successful for lower portions of the track, it is not satisfactory for upper portions thereof. Occasionally, a sailboat owner or person hired thereby will be hoisted to the top of a mast so that he may spray the track as he is lowered therealong. Such a procedure is relatively dangerous, time consuming and, if done for hire, relatively expensive. Obviously, improvements in methods of spar track lubrication are needed.

SUMMARY OF THE PRESENT INVENTION

The present invention provides apparatus for dispensing lubricant to an elongated spar track to improve the frictional operation between the spar track and sail or rigging fittings which are engageable therewith. The apparatus includes an elongated mounting plate adapted to receive a container of lubricant from which lubricant may be dispensed along the spar track. Guide members are attached to the mounting plate and are engageable with the spar track to guide the apparatus along the spar track. A rope may be attached to the mounting plate for moving the apparatus along the spar track while lubricant is being dispersed from the container of lubricant. The apparatus is adaptable for lubricating either an external spar track or an internal one.

For an external spar track which has elongated flange portions, the outer edges of which project in opposite directions, the guide members comprise at least a pair of rotatable wheel members. The axes of the wheel members are perpendicular to the mounting plate, parallel to each other and spaced apart so that the edges of one of the wheels engages the outer edge of one of the flange portions and the edges of the other of the wheels engages the outer edge of the other of the flange portions.

Internal spar tracks generally comprise an elongated channel of T-shaped cross-section defined by an elongated central opening slot from each side of which extends side slots. The guide members for the apparatus of the present invention for use with such internal spar tracks includes at least one guide member insertable through the centrally opening slot and positionable within the channel for sliding engagement with both of the side slots to guide the apparatus along the spar track in response to forces applied to the mounting plate.

Whether adapted for an internal spar track or an external spar track, the apparatus of the present invention thus provides a means of attaching a container of lubricants thereto and for moving the apparatus, with the container of lubricant thereon, along the spar track while lubricant is being dispensed therefrom to the spar track. For example, for a mast, the apparatus may be attached to the halyard and pulled to the top of the mast while lubricant is being sprayed onto the spar track and then lowered to the deck so that the entire spar track is well lubricated. Operation of the apparatus requires no one to climb or go to an inaccessible or dangerous location.

The apparatus of the present invention is relatively easy to manufacture and use and should be widely accepted by sailboat enthusiasts. It is extremely efficient in lubricating spar tracks. Many other objects and advantages of the invention will the apparent from reading the description which follows in conjunction with the accompanying drawings.

DESCRIPTION OF A PREFERRED EMBODIMENT

Figure 1:
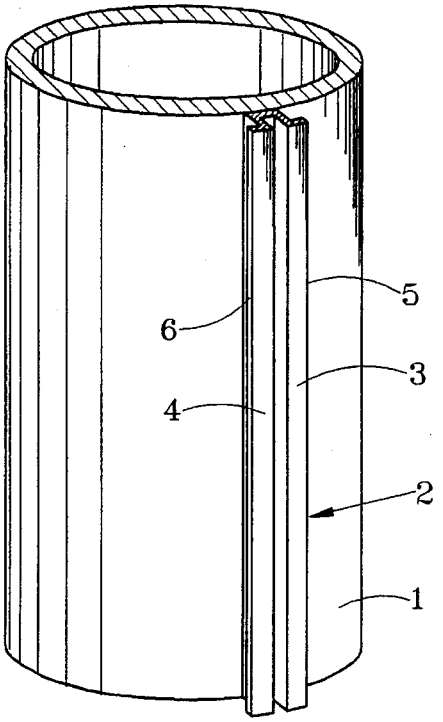
FIG. 1 is a perspective view of a portion of a spar which is provided with a spar track of the external type.
Figure 2:
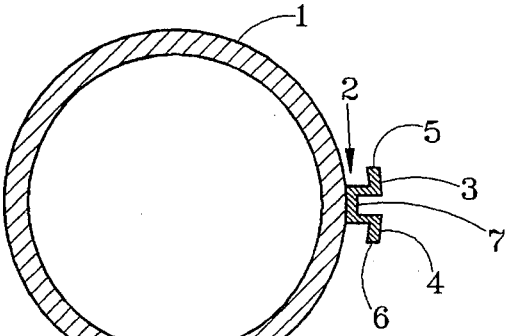
FIG. 2 is a cross-sectional view of the spar and associated external spar track of FIG. 1.

Referring first to FIGS. 1 and 2, there is shown a sailboat spar 1, such as a mast, with an associated spar track 2. The spar track is provided for engagement by slides, cars or other accessories (not shown) for attachment to the edges of a sail (not shown) to assist in raising and lowering of the sail. For example, in the case of a main mast, the edges of the mainsail would be provided with such slides, cars, etc. which engage the spar track 2. A rope or a cable referred to as the "halyard" would be attached to the top of the sail and run through a block or pulley at the top of the mast so that as a force is applied to the top of the sail through the halyard, the sail would be raised to its uppermost position, or after raising, lowered. As this occurs, the slides, cars or other rigging fixtures would travel and be guided along the spar track 2 to properly position the sail.

In the embodiment of FIGS. 1 and 2, the spar track 2 is of the external type which provides a pair of elongated flange portions 3, 4 the outer edges 5, 6 which project in opposite directions. In the particular embodiment shown, the spar track 2 may also be formed of a supporting web or body 7 which is attached in any suitable fashion to the spar 1.

Figure 3:
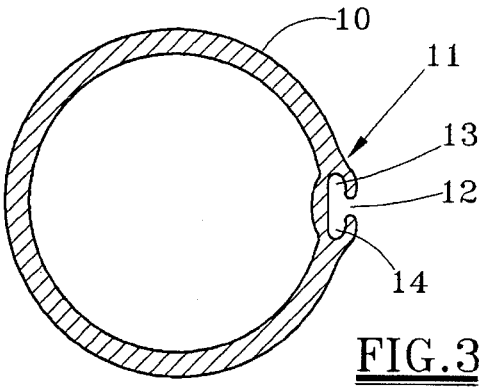
FIG. 3 is a cross-sectional view, similar to FIG. 2, but illustrating a spar with an internal spar track.

Some spars, such as the spar 10, a cross-section of which is shown in FIG. 3, may be provided with internal type spar tracks 11. The spar track 11 comprises an elongated channel of T-shaped cross-section defined by an elongated centrally opening slot 12 from each side of which extends elongated side slots 13, 14. With internal spar tracks, such as the one shown in FIG. 3, slugs or other fittings (not shown) attached to the edges of a sail slidingly engage the slots 12, 13, 14 to guide the sail as it is raised and/or lowered.

Figure 4:
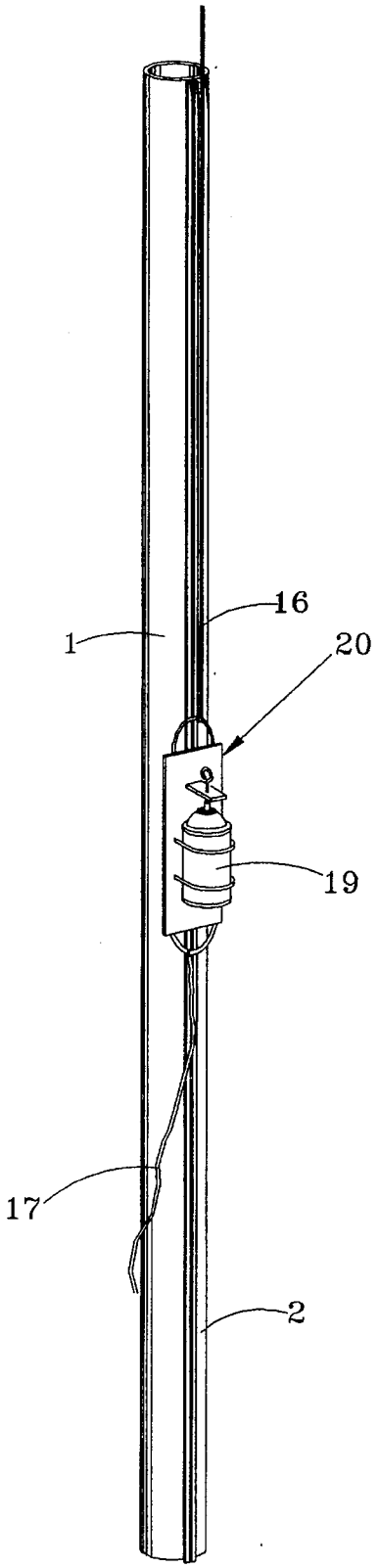
FIG. 4 is a pictorial view of a spar, having an external spar track, such as the one shown in FIGS. 1 and 2, which is being lubricated by lubrication dispensing apparatus, according to a preferred embodiment of the invention.

Referring now to FIG. 4, the spar or mast 1 of FIGS. 1 and 2 is shown with lubrication dispensing apparatus 20, according to a preferred embodiment of the invention. The lubricating apparatus 20 supports thereon a container of lubricant 19 for lubricating the spar track 2. The upper portion of the lubricant dispensing apparatus 20 is connected to the halyard 16 which travels over a block (not shown) attached to the top of the mast 1. A light line or heavy twine 17 is connected to the lower portion of the apparatus 20. As lubricant is being dispensed from the lubricant container 19, an upward force may be directed from the halyard 16 causing the apparatus 20 to move along the spar track 2. When the top of the mast or spar 1 is reached, a downward directed force may be applied to the apparatus 20 through the line or twine 17 to return the apparatus 20 the deck. As the lubricant dispensing apparatus 20 is pulled up and down the spar 1, the spar track 2 is well lubricated.

Figure 7:
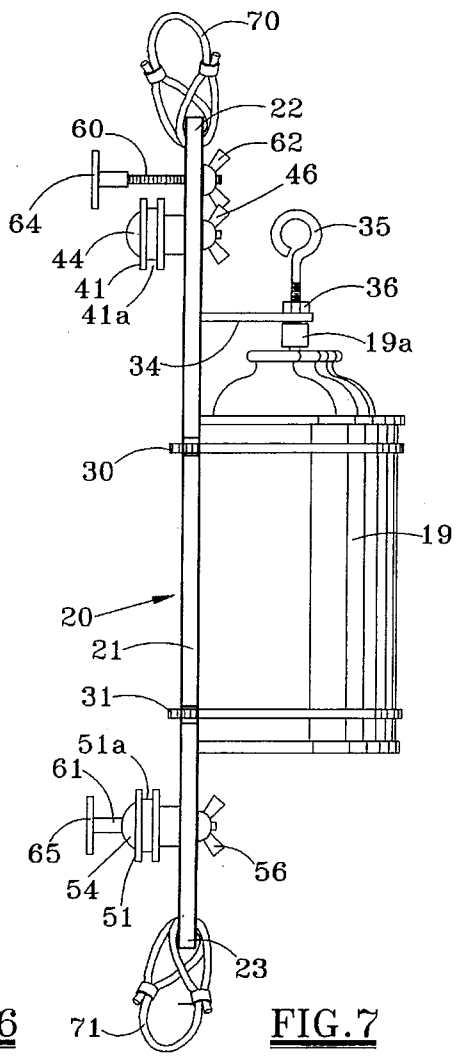
FIG. 7 is a side view of the spar track lubricating apparatus of FIGS. 5 and 6, according to a preferred embodiment of the invention.
Figure 6:
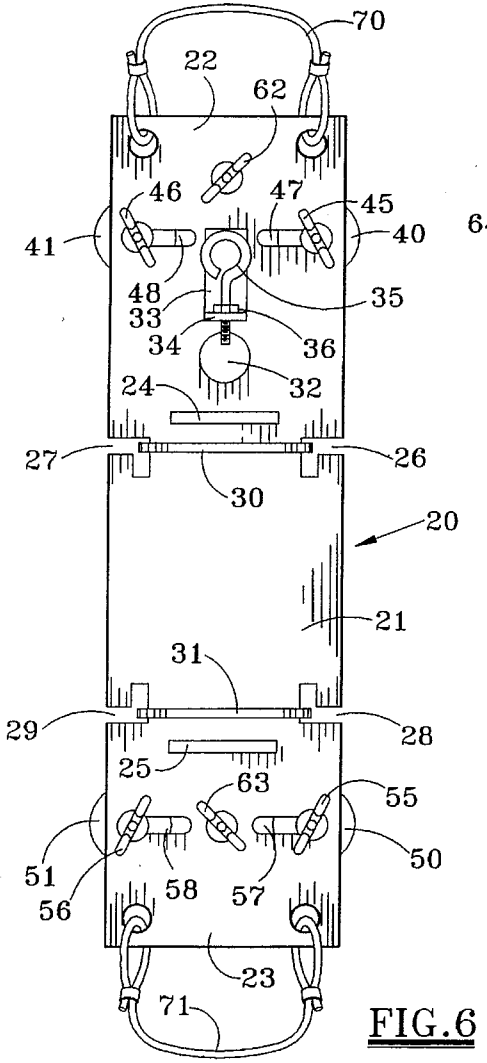
FIG. 6 is a back view of the spar track apparatus of FIG. 5, according to a preferred embodiment of the invention.
Figure 5:
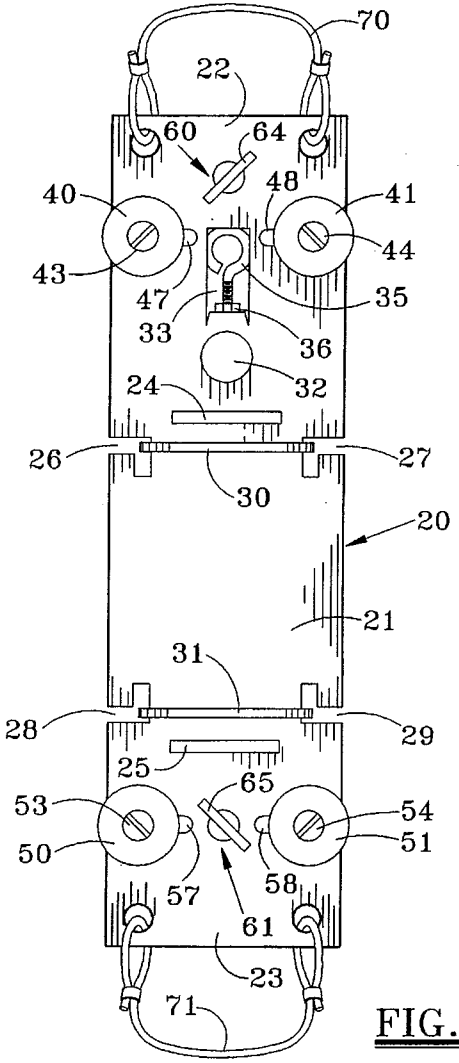
FIG. 5 is a front view of spar track lubricating apparatus, according to a preferred embodiment of the invention.

Referring now to FIGS. 5, 6 and 7, the lubricating dispensing apparatus 20 of the present invention will be described in greater detail. The apparatus 20 is provided with an elongated mounting plate 21 which in the illustrated embodiment is rectangular in shape, having what may be referred to as a top end 22 and a bottom end 23. The mounting plate 21 is adapted to receive a container of lubricants, such as a spray can of silicone 19 illustrated in FIG. 7. The can 19 may be provided with a dispenser **19*a*** which, when depressed, will spray silicone or other lubricant therefrom.

In the particular embodiment of FIGS. 5–7, the mounting plate 21 is provided with top and bottom rim slots 24, 25 and at the edges thereof with corresponding pairs of J-slots 26, 27 and 28, 29. The J-slots 26, 27 and 28, 29 receive the ends of elastic bands 30 and 31. The rim slots 24, 25 are preferably spaced so that the upper and lower rims of a can, such as the can 19, will engage the slots 24, 25 when the can is placed against the mounting plate 21 as shown in FIG. 7. The elastic bands 30 and 31 may be placed around the can 19 and in cooperation with the rim slots 24, 25, keep the can 19 in place. The mounting plate 21 is also provided with an aperture 32 for registration with a lubricant dispenser, such as dispenser **19*a*, so that lubricant may be sprayed through the aperture 32 onto a spar track when the dispenser 19*a*** is actuated.

The dispenser **19*a* may be actuated in a number of ways. In the particular embodiment of FIGS. 5–7, an opening 33 may be stamped to provide a cantilevered tab or extension 34, the distal end of which is disposed directly above where the dispenser 19*a* should be. In the exemplary embodiment, a corresponding eye-bolt 35 would engage a threaded hole in the extension 34 so that rotation of the eye-bolt 35 would result in engagement and depression of dispenser 19*a* to actuate the dispenser for the dispensing of lubricant from the lubricant container 19. With this particular type of actuation, lubricant would continue to be dispensed from the dispenser 19*a* until the eye-bolt 35 were rotated in the opposite direction to disengage the dispenser 19*a*. A lock nut 36 would hold the eye-bolt 35** in place. Of course other types of actuators could be provided.

The dispensing apparatus 20 illustrated in FIGS. 5–7 is shown equipped with components which would make the apparatus compatible with either an external spar track, such as the spar track 2 shown in FIGS. 1, 2 and 4 or an internal spar track such as the spar track 11 shown in FIG. 3. For an external spar track, the apparatus is preferably provided with two pair of wheels, a top pair 40, 41 and a bottom pair 50, 51. The wheels 40, 41, 50, 51 are rotatable on axes of which are perpendicular to the mounting plate 21. They may be conveniently mounted on bolts 43, 44, 53, 54 provided with corresponding wing nuts 45, 46 and 55, 56 for ease of assembly and adjustment. The bolts preferably extend through transverse slots 47, 48 and 57, 58 to allow adjustment of the lateral spacing between corresponding pairs of wheels. It will be noted that the edges or rims of the wheels, 40, 41 and 50, 51 are provided with grooves, such as **41*a* and 51*a* as seen in FIG. 7, for engagement with corresponding outer edges of external spar tracks, such as the edges 5, 6 of the flanges 3, 4 of the spar track 2 of FIGS. 1, 2 and 4**.

For operation with an internal spar track, such as the type shown in FIG. 3, the lubricant dispensing apparatus 20 may be provided with a pair of centrally disposed guide members 60, 61, one near the top of the apparatus 20 and one near the bottom thereof. The guide members 60, 61 in the exemplary embodiment comprise T-bolts 60, 61 and corresponding wing nuts 62, 63 which threadingly engage the T-bolts 60, 61 on the back side of the mounting plate 21. The T-bolts 60, 61 also threadingly engage holes in the mounting plate 21 through which they pass. The T-bolts 60, 61 include cross-members 64, 65 which, when longitudinally aligned are insertable through the centrally opening slot, such as slot 12 in FIG. 3, of an internal type spar track. However, by loosening the wing nuts 62, 63, the cross-members 64, 65 may be moved from a position generally in line with the centrally opening slot 12 toward a position substantially perpendicular thereto in which opposite ends of the cross-members engage opposite ones of the side slots 13, 14 preventing removal of the guide members 60, 61 from the internal spar track 11. However, the cross-members 64, 65 do not so engage the slots 13, 14 as to prevent sliding up and down in the internal spar track.

Attached in any suitable manner to the top portion of the apparatus 20 is a top sling 70. Attached in any suitable manner to the bottom of the apparatus 20 is a bottom sling 71. The purpose of the sling 70, 71 are to move the apparatus 20 up or down along the spar track to which the apparatus is attached.

As indicated, the lubricant dispensing apparatus 20 of the present invention is designed so that it may be adapted for use with either an external spar track, such as the one illustrated in FIGS. 1, 2 and 4 or an internal spar track such as the one illustrated in FIG. 3. Depending upon which type of spar track the apparatus is to be used with, certain components of the guide mechanisms should not be installed. For example, if the apparatus is to be used with an external spar track, the T-bolts 60 and 61 should not be used. To then install or attach the apparatus 20 to an external track, e.g. the external track 2 of FIGS. 1, 2 and 4, the wheels 40, 41 and 50, 51 should be placed at approximately the correct spacing so that the grooved wheels would properly engage the edges 5, 6 of flanges 3, 4. Then the wing nuts 45, 55 for wheels 40, 50 on one side would be tightened and the wing nuts 46, 56 on the other side would be loosened to allow corresponding wheels 41, 51 to slide out or in, relative to slots 48, 58. Then the wheels 40, 50 would be placed tightly against the edge 5 of the flange member 3, after which the other wheels 41, 51 would be moved until they firmly engage the opposite edge 6 of the flange 4. They would then be held tightly in place until their wing nuts 46 and 56 were tightened. When this is done, the apparatus is firmly attached to the external track 2 but may move up or down with the wheels 40, 41, 50, 51 riding on the edges 5, 6 of the flanges 3, 4.

Next, the main halyard 16 would be attached to the top sling 70, as shown in FIG. 4. The light line or heavy twine 17 would be attached to the bottom sling 71. The container of lubricant 19 would be placed against the mounting plate 21 with the rolled edges or rims fitted into the slots 24, 25. The dispenser 19*a* should be in registration with aperture 32. Elastic bands 30, 31 hold the can in place.

To make sure everything is in place and running properly a "trial run" may be conducted by pulling the apparatus 20 up the mast 1 with the halyard 16. The apparatus could be lowered by slowly releasing the halyard 16 and pulling down with the light line or twine 17 attached to the bottom sling 71.

Once the operator is ready to dispense lubricant, the eye-bolt 35 would be rotated until it sufficiently depresses the dispenser or nozzle 19*a* causing the lubricant to be sprayed through the spray aperture 32. As this is done, it may be necessary to hold the dispenser 19*a* to prevent its rotation. As lubricant is dispensed from the container 19, the apparatus 20 is pulled upwardly with the halyard 16 and then lowered by pulling on the line or twine 17. The speed at which the apparatus is pulled upwardly and downwardly will determine the amount of lubricant sprayed on the track 2.

If the apparatus 20 is to be used with an internal type track such as the track 11 of FIG. 3, all the wheel assemblies, including wheels 40, 41, 50, 51 and corresponding bolts and wing nuts should be removed and, if not already in place, the T-bolts 60, 61 attached to the mounting plate 21. The cross-members 64, 65 of the T-bolts may be lightly sprayed with lubricant and the cross-members 64, 65 placed in longitudinal alignment so that they may be inserted through the centrally opening slot 12 into the internal spar track 11. Then the bolts 60, 61 are turned until the cross-members 64, 65 engage the side slots 13, 14. The cross-members 64, 65 allow the apparatus to be utilized with internal tracks of varying dimensions. The cross-member does not have to be totally perpendicular to the track to hold the mounting plate 21 and apparatus 20 in place. After the cross-members are in proper place, the corresponding wing nuts 62, 63 are tightened to lock them in place.

When these steps are completed, the halyard 16 and twine 17 are attached to the upper and lower slings 70, 71, the container of lubricant 19 is affixed to the mounting plate 21 and the apparatus 20 operated in the same manner previously described with reference to use with an external spar track. Lubricant is sprayed into the T-slot of the internal spar track 11.

After spraying, whether an external spar track or an internal spar track, the apparatus 20 of the present invention is removed, the halyard 16 disconnected and reattached to the sail. The sail may then be pulled upwardly or downwardly with its slugs, slides, cars, etc. smoothly engaging and riding on the lubricated spar track.

Thus, the present invention provides lubricant dispensing apparatus for effectively lubricating a spar track whether it is of the external or internal type. The apparatus is relatively simple in construction. It's operation is easy. It is more efficient and less costly than other methods.

A single embodiment of the present invention has been described herein but which is adaptable for use on external or internal spar tracks with minor modifications. Many variations of the invention may be made without departing from the spirit of the invention. Accordingly, it is intended that the scope of the invention be limited only by the claims which follow.

I claim:

1. Apparatus for dispensing lubricant to an elongated spar track which comprises a pair of elongated flange portions outer edges of which project in opposite directions, said apparatus comprising:

an elongated mounting plate adapted to receive a container of lubricants from which lubricant may be dispensed toward said spar track;

guide means attached to said elongated mounting plate and engageable with said spar track to guide said apparatus along said spar track said guide means including at least a pair of rotatable wheel members, the axes of which are perpendicular to said mounting plate, parallel to each other and spaced apart so that the edges of one of said wheels engages said outer edge of one of said flange portions and the edges of the other of said wheels engages said outer edge of the other of said flange portions; and means attachable to said elongated mounting plate for moving said apparatus along said spar track while lubricant is being dispensed from a lubricant container.

2. Lubricant dispensing apparatus as set forth in claim 1 in which there are two pair of said wheel members, one pair being disposed near one end of said mounting plate and another pair being disposed near the other end of said mounting plate.

3. Lubricant dispensing apparatus as set forth in claim 1 in which the edges of said wheel members are grooved for engagement with corresponding outer edges of said flange portions.

4. Lubricant dispensing apparatus as set forth in claim 1 which said wheel members are mounted on said mounting plate so that the distance between the axes thereof may be changed to accommodate flange portions of different widths.

5. Apparatus for dispensing lubricant to an elongated spar track which comprises an elongated channel of T-shaped cross-section defined by an elongated centrally opening slot from each side of which extends side slots, said apparatus comprising:

an elongated mounting plate adapted to receive a container of lubricants from which lubricant may be dispensed toward said spar track;

guide means attached to said elongated mounting plate and engageable with said spar track to guide said apparatus along said spar track, said guide means comprising at least one guide member insertable through said centrally opening slot and positionable within said channel for sliding engagement with both of said side slots to guide said apparatus along said spar track; and means attachable to said elongated mounting plate for moving said apparatus along said spar track while lubricant is being dispensed from a lubricant container.

6. Lubricant dispensing apparatus as set forth in claim 5 in which there are a pair of said guide members, one near one end of said mounting plate, the other near the other end of said mounting plate.

7. Lubricant dispensing apparatus as set forth in claim 5 in which said guide member comprises a shaft perpendicularly projecting from said mounting plate and at one end of which is a cross-member, said cross-member being moveable from a first position generally in line with said centrally opening slot, allowing insertion into said channel, toward a second position substantially perpendicular thereto in which opposite ends of said cross-member engage opposite ones of said side slots preventing removal of said guide member from said channel.

8. Lubricant dispensing apparatus as set forth in claim 7 in which said shaft is threaded to receive a corresponding nut loosening of which allows movement of said cross-member between said first and second positions and tightening of which locks said cross-member in said second position.

9. Lubricant dispensing apparatus as set forth in either claim 1 or claim 5 including a pressurized container of lubricant received by said mounting plate and having a dispenser thereon activation of which directs a stream of lubricant toward said spar track.

10. Lubricant dispensing apparatus as set forth in claim 9 in which said mounting plate is provided with means for releasably attaching said container thereto.

11. Lubricant dispensing apparatus as set forth in claim 10 in which said mounting plate is provided with one or more horizontal slots engageable with one or more rims of said container for maintaining said container in a fixed position, said means for releasably attaching said container to said mounting plate including elastic bands attached to said mounting plate and surrounding said container.

12. Lubricant dispensing apparatus as set forth in claim 9 in which said mounting plate is provided with an aperture in registration with said container dispenser and through which said stream of lubricant may be directed toward said spar track.

13. Lubricant dispensing apparatus as set forth in claim 9 in which said mounting plate is provided with an activator above said container and engageable with said dispenser for activation thereof.

14. Lubricant dispensing apparatus as set forth in claim 13 in which said activator comprises a tab member extending away from said mounting plate above said dispenser and a threaded member carried by said tab member, rotation of said threaded member effecting engagement of one end of said threaded member with said dispenser for activation thereof.

* * * * *